US005467378A

United States Patent [19]

Lumma et al.

[11] Patent Number: 5,467,378

[45] Date of Patent: Nov. 14, 1995

[54] X-RAY APPARATUS COMPRISING A PHOTOCONDUCTOR AND A CORONA CHARGING DEVICE

[75] Inventors: Waldemar Lumma; Heinz Haarmann, both of Hamburg, Germany

[73] Assignee: U.S. Philips Corporation, New York, N.Y.

[21] Appl. No.: 314,563

[22] Filed: Sep. 28, 1994

[30] Foreign Application Priority Data

Sep. 30, 1993 [DE] Germany ..... 43 33 325.7

[51] Int. Cl.[6] ..... G03G 13/26

[52] U.S. Cl. ..... 378/32; 378/28

[58] Field of Search ..... 378/32, 28; 250/326, 250/325; 361/229, 230

[56] References Cited

U.S. PATENT DOCUMENTS 5,341,409 8/1994 Conrads et al. ..... 378/28

*Primary Examiner*—David P. Porta
*Assistant Examiner*—Don Wong
*Attorney, Agent, or Firm*—Jack D. Slobod

[57] ABSTRACT

An X-ray apparatus, includes a photoconductor for convening X-rays into a charge pattern and a corona charging device for charging the surface of the photoconductor to a defined potential prior to an X-ray exposure. Deposits of dust on the corona charging device, and the associated artefacts in the X-ray image, are avoided in that there is provided a control unit for operating the corona charging device in a charging mode and in a cleaning mode, a first voltage being applied to the corona charging device in the charging mode whereas in the cleaning mode a second voltage is applied thereto which has, at least temporarily, a polarity which opposes that of the first voltage.

18 Claims, 2 Drawing Sheets

X-RAY APPARATUS COMPRISING A PHOTOCONDUCTOR AND A CORONA CHARGING DEVICE

BACKGROUND OF THE INVENTION

The invention relates to an X-ray apparatus, comprising a photoconductor for converting X-rays into a charge pattern and a corona charging device for charging the surface of the photoconductor to a defined potential prior to an X-ray exposure. An X-ray apparatus of this kind is known from DE-OS 40 15 113.

It has been found that in the course of time the X-ray images produced by means of such an X-ray apparatus contain artefacts which become more pronounced upon ageing. In the known X-ray apparatus, in which the photoconductor is provided on a drum and the corona charging device extends axially along the surface of the photoconductor, charging takes place while the drum rotates and these artefacts are shaped as stripes.

SUMMARY OF THE INVENTION

It is an object of the present invention to eliminate these artefacts. This object is achieved in accordance with the invention in that there is provided a control unit for operating the corona charging device in a first mode and in a second mode, the corona charging device receiving in the first mode a first voltage and in the second mode a second voltage of a polarity which opposes that of the first voltage at least temporarily.

The inventors have established that these artefacts are caused by dust which is deposited on the parts of the corona charging device where the highest electric field strength occurs during operation. These dust deposits reduce the number of emitted charge carriers at these areas, so that the photoconductor surface is no longer uniformly charged. Irregular charging of the photoconductor surface causes the artefacts in the X-ray image. In accordance with the invention, in addition to the first mode in which the photoconductor is uniformly charged to a defined potential, there is provided a second mode. In the second mode the corona charging device receives a voltage of a polarity which opposes that of the direct voltage received in the first mode. The dust particles deposited on the corona charging device in the first mode are electrostatically repelled by the voltage applied in the second mode, thus eliminating the causes of the artefacts in the X-ray image. Because of this function, the second mode of operation will also be referred to as the cleaning mode hereinafter, whereas the first mode will also be referred to hereinafter as the charging mode.

In a preferred embodiment there is provided a first direct voltage source which is connected to the corona charging device in the first mode, and also a second direct voltage source which is connected to the corona charging device in the second mode, the voltage supplied by the second direct voltage source having a polarity opposing that of and being smaller than the voltage supplied by the first voltage source. The voltage supplied by the second voltage source should preferably be so small that no gas discharge occurs in the corona charging device in the cleaning mode. In a further embodiment the photoconductor comprises a photoconductor layer on an electrically conductive carrier, said carrier being connected to the second direct voltage source. Thus, in this case the cleaning mode utilizes a direct voltage source which is required anyhow for operation of the photoconductor device and which supplies a direct voltage of the required polarity.

In another embodiment of the invention, however, the control unit comprises a switching device which is connected between a direct voltage source and the corona charging device and which supplies the corona charging device with the voltage supplied by the direct voltage source in the first mode with a first polarity and supplies this voltage with a polarity opposing the first polarity in the second mode. Again no additional direct voltage source is required, but the voltage applied to the corona charging device in the cleaning mode is so high that an undesirable gas discharge occurs in this mode.

Finally, in a further embodiment of the invention there is provided a direct voltage source which is connected to the corona charging device in the first mode, there also being provided an alternating voltage source which is connected to the corona charging device in the second mode. This possibility makes sense notably when an alternating voltage source is present anyway. However, the cleaning effect that can thus be achieved is not as thorough as in the preferred embodiment.

In principle an improvement would already be achieved by operating the device in the cleaning mode only occasionally. In a preferred embodiment of the invention, however, operation in the first mode is always followed by operation in the second mode. As a result, dust cannot even settle on the corona charging device.

In a further embodiment of the invention, the duration of operation in the second mode is approximately equal to the duration of operation in the first mode. If the duration of the cleaning mode were substantially shorter than that of the charging mode, it might occur that dust deposits are only incompletely removed; if a cleaning mode, however, were substantially longer than the charging mode, in the cleaning phase dust particles, oppositely charged relative to the dust particles deposited on the corona charging device in the charging mode, could reach the corona charging device and influence its function.

In a further embodiment of the invention at least one conductive surface is provided in the vicinity of the photoconductor, outside the corona charging device, which surface is connected to a direct voltage source. As a result, the dust particles floating in the vicinity of the photoconductor are at least partly attracted by the conductive surfaces, so that they cannot contaminate the corona charging device.

BRIEF DESCRIPTION OF THE DRAWING

The invention will be described in detail hereinafter with reference to the drawing. Therein.

DETAILED DESCRIPTION OF THE PREFERRED DISCLOSURE

Figure 1:
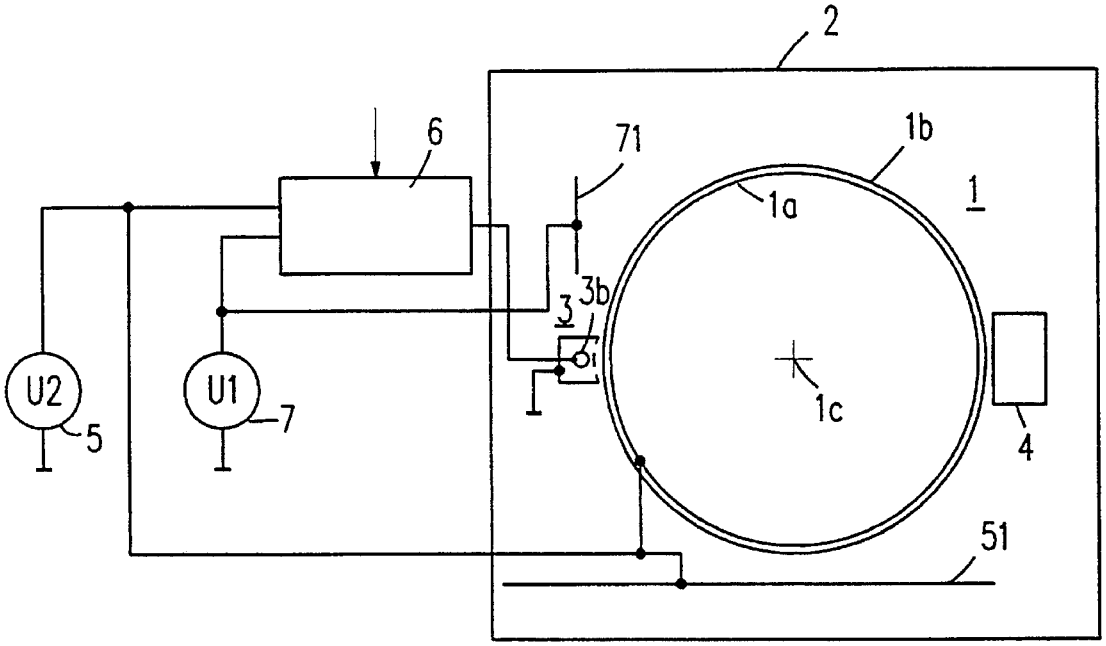
FIG. 1 shows diagrammatically a part of an X-ray apparatus in accordance with the invention.

The reference numeral 1 in FIG. 1 denotes a photoconductor device which comprises a cylindrical or drum-shaped carrier body 1*a* of aluminium, on the outer surface of which there is provided a photoconductor layer l*b*, for example a selenium layer having a thickness of 0.5 mm. The photoconductor device 1 is accommodated in a housing 2 which seals the photoconductor 1 in a light-tight manner, but which is transparent to X-rays at least on one side, for example its upper side. The carrier body 1 is connected to a direct voltage source 5 which supplies a negative direct voltage U2 of, for example −1.5 kV.

Prior to an X-ray exposure, the surface of the photoconductor layer 1*b* is uniformly charged to a defined potential, for example zero volts, by a corona charging device 3; the photoconductor 1 rotates about its cylinder axis 1*c* during charging. An X-ray exposure influences the electrical conductivity of the layer 1*b* in dependence on the intensity of the X-rays, so that there is formed a charge pattern which corresponds to the relevant X-ray image. Subsequent to the X-ray exposure, the charge pattern thus formed is convened into electric signals by means of a read unit 4, which electric signals are processed so as to form a digital X-ray image. The X-ray device of FIG. 1 as described thus far is known from DE-OS 40 15 113.

The corona charging device 3 extends perpendicularly to the plane of drawing of FIG. 1, parallel to the surface of the photoconductor 1. It comprises a grounded housing 3*a* having a U-shaped cross-section, its open side facing the photoconductor. The housing 3*a* accommodates a wire 3*b*; preferably, a grid which is also grounded is provided between said wire and the photoconductor. In comparison with the photoconductor 1, the corona charging device 3 has not been shown at the correct scale. The distance between the side walls of the housing 3*a* may amount to, for example 13 mm whereas the diameter of the wire 3*b* amounts to only 70 μm.

During the charging of the photoconductor 1, the wire 3*b* of the corona charging device carries a positive voltage of, for example 4 kV. Consequently, a substantially inhomogeneous electric field arises around the wire 3*b*, which field causes a gas discharge.

Figure 2:
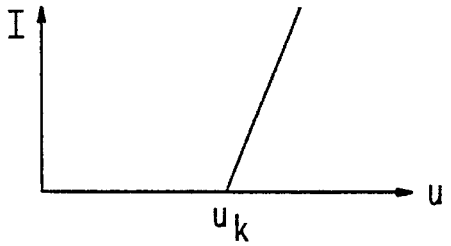
FIG. 2 shows the current-voltage characteristic of the corona charging device included therein.

FIG. 2 shows the current through the wire 3*b* as a function of the voltage between the wire 3*b* and the housing 3*a*. It appears that a current flux commences only as from a given voltage $U_k$. The voltage $U_k$ is dependent on the construction of the corona charging device 3 and amounts to, for example 3 kV. During charging the wire 3*b* receives a voltage U1 from a direct voltage source 7, which voltage U1 is higher than the voltage $U_k$. As has already been stated, this voltage amounts to 4 kV; its polarity opposes that of the voltage U2. As a result, in the area around the wire 3*b* a gas discharge occurs which ionizes the air molecules present at that area. The positive charge carriers thus formed reach the surface of the photoconductor 1, through the meshes of of said grid, and charge this surface. When this charge reaches the potential of the grounded housing 3*a*, substantially no further charge carriers will reach the photoconductor, but only the housing 3*a* or said grid.

The discharging operations electrically charge also the dust particles present within the housing 2. The negatively charged dust particles are attracted by the wire 3*b*. This dust deposit reduces the number of charge carriers generated per unit of time, so that the photoconductor surface will only be incompletely and non-uniformly charged in a given period of time. This causes stripe-like artefacts in the X-ray image.

Figure 3:
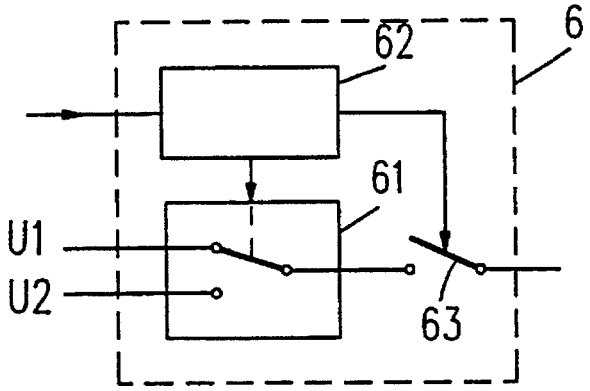
FIG. 3 shows a block diagram of the control unit used therein.

In order to prevent the deposit of dust and the artefacts in the X-ray images, the wire 3*b* of the corona charging device 3 can be connected to one of the two direct voltage sources 5 and 7 via a control unit 6. As appears from FIG. 3, the control unit 6 comprises a switch 61 and a switch 63, which switches are controlled by a control circuit 62. The control circuit 62 itself is controlled by other parts of the X-ray apparatus.

In a first mode of operation, i.e. the charging mode, the switch 63 is closed and the switch 61 connects the wire 3*b* to the voltage source 7. The surface of the photoconductor 1 is then charged. Charging terminates at the beginning of the X-ray exposure. Subsequently, the circuit is operated in a second mode, i.e. the cleaning mode, in which the switch 61 is switched over so that it connects the voltage source 5 to the wire 3*b*. Dust particles collected on the wire are thus repelled, or the wire cannot be reached by such dust particles. It is advantageous when the absolute value of the negative direct voltage U2 supplied by the direct voltage source 5 (−1.5 kV) is smaller than that of the voltage $U_k$ of the corona charging device and cannot generate charge carriers in the cleaning mode.

It has been found that a particularly attractive result is obtained when the duration of the cleaning mode corresponds approximately to the duration of the charging mode. If the cleaning mode is substantially shorter, in given circumstances not all dust particles will be removed. However, if the cleaning mode is substantially longer, positively charged dust particles may settle on the wire. When the duration of the charging mode is constant, the cleaning mode must also be switched on for this constant period of time; however, if the duration of the charging mode is variable, the control circuit 62 should include a device for measuring the duration of the charging mode; the cleaning mode should then be terminated after said measured period of time. The cleaning mode is terminated by opening the switch 63.

Also provided in the housing are two sheets 71 and 51 which are connected to the direct voltage sources 5 and 7, respectively, and on which a part of the dust particles floating in the housing 2 is deposited. The probability of such a dust particle reaching the corona charging device is thus reduced even further.

If no second direct voltage source for generating a direct voltage of opposite polarity, like the direct voltage source 5, is available, use can be made instead of an alternating voltage source. The cleaning effect of an alternating voltage source, however, generally is less, because an alternating voltage always has the necessary polarity for one half period only.

Figure 4:
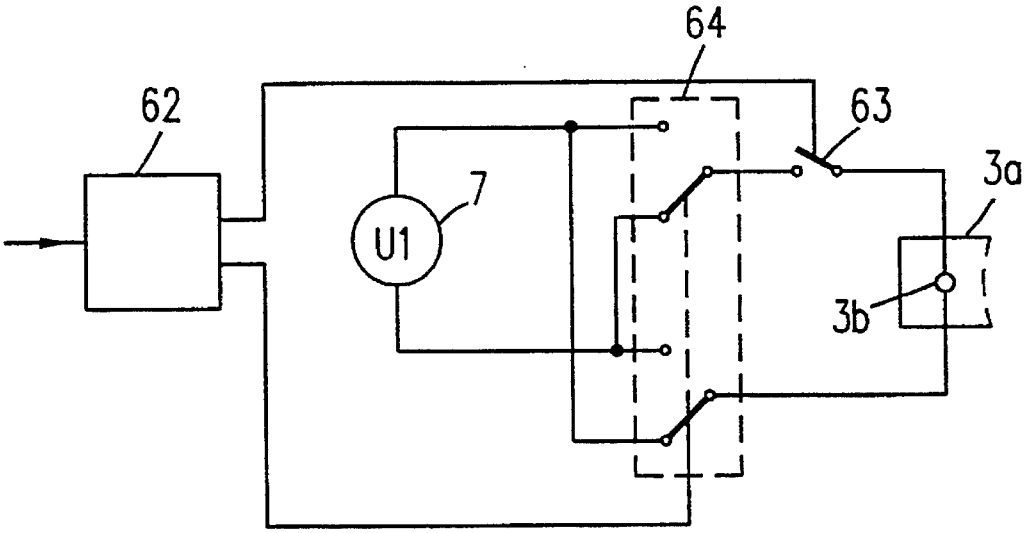
FIG. 4 shows a circuit diagram of a part of a further embodiment of the invention.

FIG. 4 shows a control unit enabling execution of the charging mode and the cleaning mode by means of only a single direct voltage source 7. In this case the direct voltage source 7 is connected to the corona charging device via a switching device 64, enabling the direct voltage U1 to be applied to the parts 3*a* and 3*b* of the corona charging device with reversed polarity. It is a drawback that a gas discharge occurs also during the cleaning mode. Moreover, breakdowns could occur between the housing 3*a* and the photoconductor.

We claim:

1. An X-ray apparatus, comprising a photoconductor (1) for convening X-rays into a charge pattern, and a corona charging device (3) for charging the surface of the photoconductor to a defined potential prior to an X-ray exposure, and a control unit (6) for operating the corona charging device (3) in a first mode and in a second mode, the corona charging device (3) receiving in the first mode a first voltage (U1) and in the second mode a second voltage (U2) of a polarity which opposes that of the first voltage at least temporarily.

2. An X-ray apparatus as claimed in claim 1, further comprising a first direct voltage source (7) which is connected to the corona charging device (3) in the first mode, and a second direct voltage source (5) which is connected to the corona charging device (3) in the second mode, the voltage supplied by the second direct voltage source having a polarity opposing that of and being smaller than the voltage supplied by the first voltage source.

3. An X-ray apparatus as claimed in claim 2, characterized in that the photoconductor (1) comprises a photoconductor layer (1*b*) on an electrically conductive carrier (1*a*), said carrier (1*a*) being connected to the second direct voltage source (5).

4. An X-ray apparatus as claimed in claim 1, characterized in that the control unit (6) comprises a switching device (64) which is connected between a direct voltage source (7) and the corona charging device and which supplies the corona charging device (3) with the voltage supplied by the direct voltage source in the first mode with a first polarity and supplies this voltage with a polarity opposing the first polarity in the second mode.

5. An X-ray apparatus as claimed in claim 1, further comprising a direct voltage source which is connected to the corona charging device in the first mode, there also being provided an alternating voltage source which is connected to the corona charging device in the second mode.

6. An X-ray apparatus as claimed in claim 1, characterized in that operation in the first mode is always followed by operation in the second mode.

7. An X-ray apparatus as claimed in claim 1, characterized in that the duration of operation in the second mode is approximately equal to the duration of operation in the first mode.

8. An X-ray apparatus as claimed in claim 1, characterized in that at least one conductive surface (51, 71) is provided in the vicinity of the photoconductor (1), outside the corona discharging device, which surface is connected to a direct voltage source.

9. An X-ray apparatus as claimed in claim 2, characterized in that operation in the first mode is always followed by operation in the second mode.

10. An X-ray apparatus as claimed in claim 3, characterized in that operation in the first mode is always followed by operation in the second mode.

11. An X-ray apparatus as claimed in claim 4, characterized in that operation in the first mode is always followed by operation in the second mode.

12. An X-ray apparatus as claimed in claim 5, characterized in that operation in the first mode is always followed by operation in the second mode.

13. An X-ray apparatus as claimed claim 2, characterized in that the duration of operation in the second mode is approximately equal to the duration of operation in the first mode.

14. An X-ray apparatus as claimed claim 3, characterized in that the duration of operation in the second mode is approximately equal to the duration of operation in the first mode.

15. An X-ray apparatus as claimed claim 4, characterized in that the duration of operation in the second mode is approximately equal to the duration of operation in the first mode.

16. An X-ray apparatus as claimed claim 5, characterized in that the duration of operation in the second mode is approximately equal to the duration of operation in the first mode.

17. An X-ray apparatus as claimed claim 6, characterized in that the duration of operation in the second mode is approximately equal to the duration of operation in the first mode.

18. An X-ray apparatus as claimed in claim 2, characterized in that at least one conductive surface (51, 71) is provided in the vicinity of the photoconductor (1), outside the corona discharging device, which surface is connected to a direct voltage source.

* * * * *